US012559202B2

(12) United States Patent
Tell et al.

(10) Patent No.: US 12,559,202 B2
(45) Date of Patent: Feb. 24, 2026

(54) MARINE PROPULSION SYSTEM AND MARINE VESSEL COMPRISING A MARINE PROPULSION SYSTEM

(71) Applicant: Volvo Penta Corporation, Gothenburg (SE)

(72) Inventors: Johan Tell, Gothenburg (SE); Lars Johansson, Sävedalen (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 413 days.

(21) Appl. No.: 18/104,937

(22) Filed: Feb. 2, 2023

(65) Prior Publication Data

US 2023/0286613 A1 Sep. 14, 2023

(30) Foreign Application Priority Data

Mar. 9, 2022 (EP) ..... 22161015

(51) Int. Cl.

| | |
|---|---|
| ***B63B 1/24*** | (2020.01) |
| ***B63B 1/28*** | (2006.01) |
| ***B63H 21/17*** | (2006.01) |
| ***B63H 25/42*** | (2006.01) |

(52) U.S. Cl.

CPC ..... *B63B 1/246* (2013.01); *B63B 1/242* (2013.01); *B63B 1/283* (2013.01); *B63H 21/17* (2013.01); *B63H 25/42* (2013.01)

(58) Field of Classification Search

CPC ..... B63B 1/242; B63B 1/246; B63B 1/283; B63H 21/17; B63H 25/42

See application file for complete search history.

(56) References Cited

U.S. PATENT DOCUMENTS

| | | | |
|---|---|---|---|
| 4,953,492 A | 9/1990 | Duffty | |
| 2016/0176483 A1 | 6/2016 | Chiang et al. | |

FOREIGN PATENT DOCUMENTS

| | | | | |
|---|---|---|---|---|
| AU | 2021104570 A4 | | 9/2021 | |
| GB | 2550123 A | * | 11/2017 | ..... B63B 39/06 |
| WO | 1991005696 A1 | | 5/1991 | |
| WO | 20160009409 A1 | | 1/2016 | |
| WO | WO-2016009409 A1 | * | 1/2016 | ..... B63H 20/08 |

OTHER PUBLICATIONS

Extended European Search Report, European Patent Application No. 22161015.7, mailed Sep. 26, 2022, 7 pages.

* cited by examiner

*Primary Examiner* — Stephen P Avila
(74) *Attorney, Agent, or Firm* — Sage Patent Group

(57) ABSTRACT

A marine propulsion system includes wings with a hydrofoil shaped geometry arranged for mounting on opposite side sections of a vessel comprising at least one hull adjacent the transom. Each wing includes a first section extending downwards along the side of the hull and at least partially below the waterline in its operative position. Each wing includes a second section extending towards the central longitudinal axis of the hull in its operative position. The second section each wing is arranged to support at least one propulsor. The first section of each wing is mounted rotatable about a vertical axis.

11 Claims, 12 Drawing Sheets

MARINE PROPULSION SYSTEM AND MARINE VESSEL COMPRISING A MARINE PROPULSION SYSTEM

CROSS REFERENCE TO RELATED APPLICATIONS

This application claims priority to European Application No. 22161015.7, filed on Mar. 9, 2022, the disclosure and content of which is incorporated by reference herein in its entirety.

TECHNICAL FIELD

The present disclosure relates to a marine propulsion system mounted on opposite sides of the hull on a marine vessel and to a vessel comprising such a marine propulsion system.

BACKGROUND

Known marine vessels commonly comprise one or more propulsion units such as an outboard engine, a stern drive or a pod or azimuthing drive.

Outboard engines are attached to the transom and will as a rule take up most of the space at the stern portion of the hull. As the rearmost portion of the vessel will be taken up by the engines, the fitting of a stern swim platform or similar accessories will be difficult, if not impossible.

Stern drives and a pod drives can be driven by an internal combustion engine (ICE) arranged within the hull of the vessel. Torque is then transmitted from the ICE through the hull to the propulsion elements. Mounting a drive unit and the transmission for such drive units within the hull of the vessel can utilize a significant amount of space. In operation, heat from the drive unit may be removed using a cooling system which as a rule employs water drawn in from the ambient marine environment. This often involves drawing in saline water from the sea and pumping it through the coolant system, which can cause problems with corrosion. Further, vibration isolation and dampers may be installed to avoid undesirable vibrations from a vibration generated by rotary components in the drive unit being transmitted to the hull or other parts of the vessel. In the case of a stern drive, the transmission may pass through the transom of the vessel to reach the outer stern drive and the propellers. In the case of a pod drive, the transmission may pass through the lower part of the hull to reach the outer pod drive. In both cases this may utilize a suitable sealing arrangement between an opening in the transom or the hull and a rotary transmission shaft to prevent water from leaking into the hull.

All the above-mentioned drive units are also mounted either below near the waterline, which creates a problem not only for access during maintenance, but also for a simple visual inspection of the drives and their propellers.

The disclosure provides an improved marine propulsion system aiming to solve the above-mentioned problems.

SUMMARY

An object of the disclosure is to provide a marine propulsion system for a marine vessel, which arrangement solves the above-mentioned problems.

The object is achieved by a marine propulsion system and a marine vessel comprising such a stern platform arrangement according to the appended claims.

In the subsequent text, the term "propulsor" is defined as a propulsion unit for propelling and maneuvering the vessel. The propulsors are preferably electrically driven but are not limited to this option. Alternatively, the propulsors can be driven by a source of hydraulic pressure. The propulsors are mounted on a pair of wings which have a hydrofoil shaped geometry. When the wings are in their operative positions the propulsors are mounted on submerged free ends of the respective wing. However, the wings do not function as conventional hydrofoils which are usually fixed and can lift the hull clear of the water at elevated speeds.

In the text, the term "central longitudinal axis" denotes an axis that extends through the centre of a hull, between the bow to the stern. Preferably, the centre of gravity of the vessel should coincides with the central longitudinal axis of the vessel, in order to avoid listing. For a single hull vessel, the central longitudinal axis of the vessel corresponds to the central longitudinal axis of the hull. For a multi-hull vessel, such as a catamaran or a trimaran, the vessel itself will have a central longitudinal axis. However, each individual hull will have its own central longitudinal axis, which will either coincide with or be parallel to the central longitudinal axis of the vessel. In the subsequent text, the central longitudinal axis will be used for both the vessel and for each hull, where applicable.

Further, the term "vertical axis" is used to denote the main extension of a first portion of each wing, from its attachment point and downwards along the hull. It should be noted that the wings are rotatable about a horizontal axis extending through the hull. Hence, the first portion of each wing extends substantially vertically downwards only when the wing is positioned in a neutral, non-angled datum position. The term "horizontal axis" is used to denote a transverse horizontal axis through the attachment points of the respective wing. The horizontal axis is orthogonal to the longitudinal central axis but does not necessarily intersect this axis.

According to a first aspect of the disclosure, the disclosure relates to a marine propulsion system comprising wings with a hydrofoil shaped geometry arranged for mounting on a longitudinal side section of a vessel comprising at least one hull. The wings are located adjacent the transom of the hull onto which they are mounted. The propulsion system comprises at least one pair of wings mounted equidistant from the central longitudinal axis of the vessel, measured in the transverse direction of the central longitudinal axis. Each wing comprises a first section extending downwards along the side section of the hull and at least partially below the waterline when the wing is in its operative position. In this position, the first section is mounted to the side section of the hull at or adjacent its upper end. Each wing further comprises a second section joined to a lower end of the first section. The second section extends at an obtuse angle away from the extension of the first section. The magnitude of this angle can be selected to substantially conform to the angle between the side of the vessel and the bottom of the hull adjacent the respective wing. Alternatively, the angle is selected so that the one or more propulsors mounted on the second section will clear the underside of the hull when the wing is in its operative position. The second section each wing is arranged to support at least one propulsor.

According to a first example, the propulsion system is mounted on the opposing outer longitudinal sides of a vessel comprising a single hull or twin hulls. Alternatively, the propulsion system is mounted on the opposing outer longitudinal sides of the central hull of a vessel comprising three hulls. In this example, each second section extends from the lower end of its corresponding first section of the respective wing and towards the central longitudinal axis of the hull on which the wing is mounted. In the above examples, the second sections of each pair of wing will extend towards each other.

According to a second example, the propulsion system is mounted on facing outer longitudinal sides of a vessel comprising twin hulls. In this example, each second section extends from the lower end of its corresponding first section of the respective wing and towards the central longitudinal axis of the hull on which the wing is mounted. In the above example, the second sections of each pair of wings will extend away from each other.

When the wings are located in their operative positions, the wings and their propulsion systems can be used for driving, steering and adjusting the attitude of the vessel. According to a first example, the first section of each wing is mounted rotatable about a vertical axis to facilitate turning of the vessel. When the first section is rotated an angle about its vertical axis by a suitable actuator, then the propulsors mounted on the second section will be rotated together with the first section. The thrust from the propulsors on each wing will then cause the vessel to turn or move in a desired direction.

For instance, when both wings are rotatable simultaneously in the same direction about their vertical axes, then the thrust from the propulsors will cause a turning movement of the vessel. In this example, the respective first sections can be rotated over the same, or substantially the same angle. This operation is primarily used when the vessel is travelling in a substantially forward or rearward direction.

Alternatively, each wing can be individually rotatable about its vertical axis. In this example, the respective first sections can be rotated in the same direction over dissimilar angles, or in opposite directions into freely selectable angles. This operation is primarily suited for low speed maneuvering in a marina and during docking and can be combined with a change in direction for the thrust from the propulsors. In this way the vessel can be driven forwards or backwards at a desired angle relative to the central longitudinal axis and even be displaced sideways during docking.

According to a second example, the first section of each wing can also or additionally be mounted rotatable about a common transverse horizontal axis substantially at right angles to the central longitudinal axis of the vessel. For instance, when both wings are simultaneously rotated an equal angle about the horizontal axis and in the same direction, then this facilitates trim of the at least one hull. For instance, if the wings are rotated so that the second sections are displaced to the rear of a position where the first sections are in a substantially vertical datum position, then the angled second sections cause a downward force that will lower the stern relative to the waterline. This position is suitable for trimming a vessel that is too heavy at the bow section, or for creating a wave suitable for wakeboarding. Similarly, if the wings are rotated so that the second sections are displaced to the front of the position where the first sections are in a substantially vertical datum position, then the angled second sections cause an upward force that will lower the bow relative to the waterline.

Alternatively, each wing can be individually rotated over unequal angles about the horizontal axis relative to vertical datum position, in order to facilitate counteraction of an undesired list of the at least one hull. Depending on the magnitude of correction needed for counteracting a list, one or both wings can be rotated.

In addition to the operative position described above, the wings can be displaced in at least one Inoperative position. According to a first example, each wing is rotatable from its operative position into a first inoperative position, where the first section extends rearwards relative to its operative position and where the second section and the at least one propulsor is arranged rearwards of the transom. This position is suitable for lifting the propulsors out of the water during mooring, in order to reduce the effects of marine growth and corrosion during periods of inactivity.

According to a second example, each wing is rotatable from its operative position into a second inoperative position, where the first section extends upwards relative to its operative position and where the second section and the at least one propulsor is arranged above the transom. This position is suitable for lifting the propulsors clear of the hull to a height and position wherein the propulsors and the wings are accessible for service. In this way, service and maintenance can be performed without having to remove any parts or the propulsion system from the vessel.

The marine propulsion system can comprise wings provided with at least one propulsor. The propulsors are preferably, but not necessarily, electric motors. According to a first example, the at least one propulsor comprises a conventional pushing thruster with one or more propellers at the trailing edge of the wing. According to a second example, the at least one propulsor comprises a pulling thruster with one or more propellers at the leading edge of the wing. According to a third example, the at least one propulsor comprises a combination of the above arrangements, with a pulling thruster at the leading edge of the wing and a pushing thruster at the trailing edge of the wing.

According to a second aspect of the disclosure, the disclosure relates to a marine vessel provided with a marine propulsion system as described in the above examples. As described above, the propulsion system comprises wings mounted on opposite sides of a vessel comprising at least one hull or mounted on facing sides of a vessel comprising two hulls.

The marine propulsion system according to the disclosure solves the problem of providing a stern drive or outdrive with electric propulsion without significant modifications of the hull or transom of a vessel. Further, the conventional interface for mounting a stern drive and its steering gear connections to a transom can be eliminated. Similarly, as a conventional inboard drive unit can be eliminated there is no need for an opening through the transom or for an associated sealing means for a drive shaft. In this way conventional drive units can be replaced by smaller and lighter electric motors and fuel tanks can be replaced by one or more battery packs which can be located in suitable positions for improved weight distribution.

A further advantage is that the pivotable wing arrangements with one or more propulsors can be used not only for propelling the vessel, but also for trim and for counteracting list. This eliminates the need for separate trim planes mounted to the hull below the waterline.

A further advantage is that the mounting of one or more propulsion units to a pivotable wing arrangement provides easy access to the propulsion unit for maintenance or for replacing parts thereof, such as a propeller. Pivoting the wings and the attached propulsion units to an angle of, for instance, 180° facilitates removal or maintenance of the propulsors, as the fastener means attaching the propulsors to the wings are freely accessible and can be removed safely when the entire unit is lifted out of the water to a position above the hull.

Further advantages and advantageous features of the disclosure are disclosed in the following description and in the dependent claims.

BRIEF DESCRIPTION OF THE DRAWINGS

With reference to the appended drawings, below follows a more detailed description of embodiments of the disclosure cited as examples. In the drawings.

DETAILED DESCRIPTION OF EXAMPLE EMBODIMENTS OF THE DISCLOSURE

Figure 1:
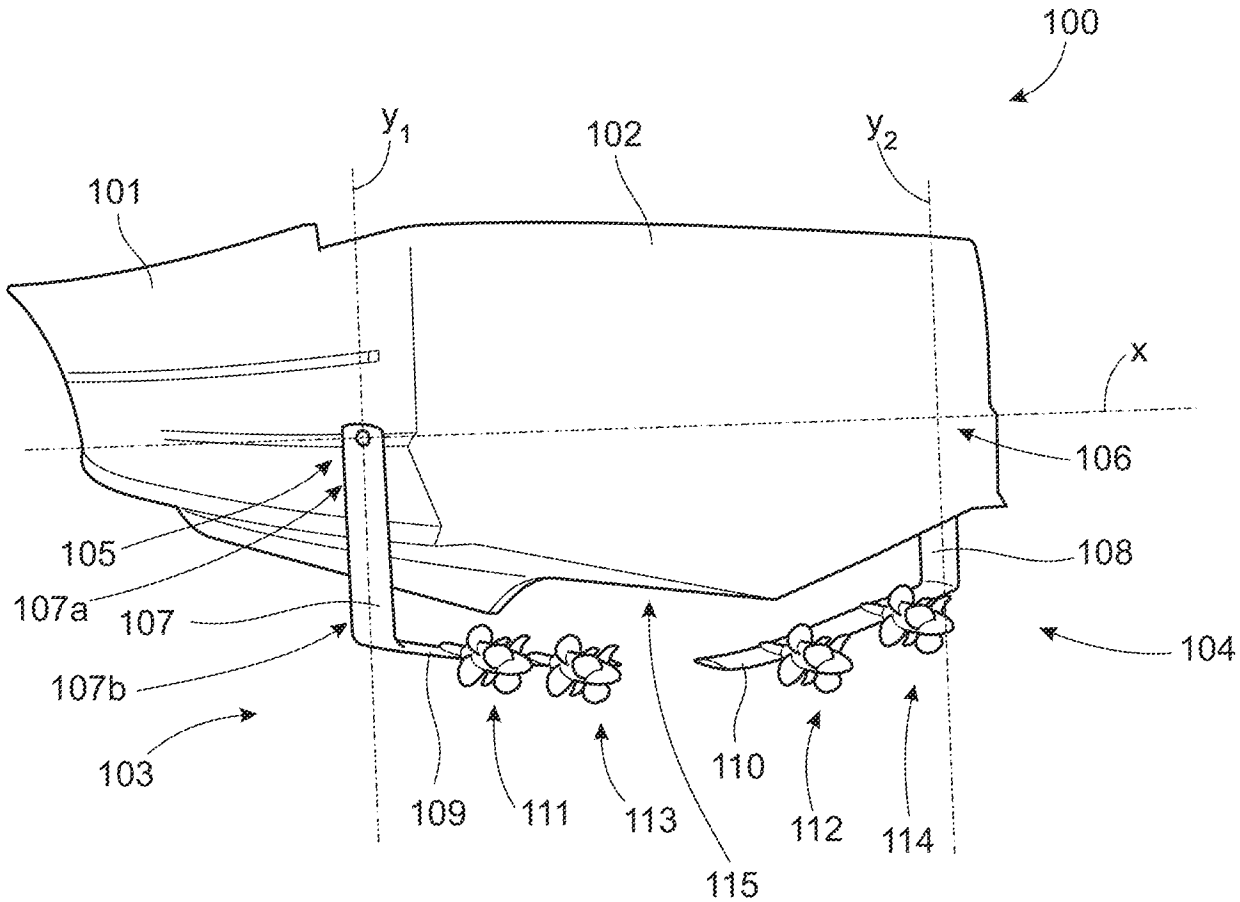
FIG. 1 shows a perspective rear view of a schematically illustrated vessel with a marine propulsion system comprising a set of wings in an operative position.

FIG. 1 shows a perspective rear view of a schematically illustrated vessel 100 with a marine propulsion system comprising a set of wings 103, 104 with propulsors 111, 112, 113, 114. The wings 103, 104 in FIG. 1 are shown in an operative position for propelling the vessel. The wings 103, 104 have a hydrofoil shaped geometry and are arranged for mounting at attachment points 105, 106 (one shown) on opposite longitudinal side sections 101 (one shown) above the waterline of a vessel comprising a single hull. The wings 103, 104 are located adjacent the transom 102 of the hull onto which they are mounted. FIG. 1 shows a vessel with single hull.

Each wing comprises a first section 107, 108 extending downwards along the side section 101 of the hull 115 and at least partially below the waterline when the wing is in its operative position. In this position, the first section 107, 108 is mounted to the side section 101 of the hull at or adjacent its upper end 107*a* (one shown). Each wing 103, 104 further comprises a second section 109, 110 joined to a lower end 107*b* (one shown) of the first section 107,108. The second section 109, 110 extends at an obtuse angle away from the main extension of the first section 107, 108. In this example, the second sections 109, 110 of each pair of wings 103, 104 will extend towards each other, but without coming into contact. The main extensions of the first sections 107,108 are indicated by the vertical axes $Y_1$ and $Y_2$, respectively, which axes pass through the respective attachment point 105, 106. The magnitude of this angle can be selected to substantially conform to the angle between the side of the vessel and the bottom of the hull adjacent the respective wing. Alternatively, the angle is selected so that the propulsors 111, 112, 113, 114 mounted on the second sections 109, 110 will clear the underside of the hull 115 when the wings 103, 104 are in their operative positions. The second section of each wing is arranged to support at least one propulsor. The embodiment in FIG. 1 shows wings 103, 104 supporting two propulsors each. The propulsors 111, 112, 113, 114 in FIG. 1 comprise electric motors, operating as pushing thrusters with twin propellers at the trailing edge of the wing. Alternatively, the propulsors can comprise pulling thrusters with one or more propellers at the leading edge of the wing. According to a further alternative, the propulsors can comprise a combination of pushing and pulling thrusters at opposite edges of the wing. The number of propulsors is limited by the size of the wings and the vessel to which it is mounted.

When the wings 103, 104 are located in their operative positions, the wings 103, 104 and their propulsors 111, 112, 113, 114 can be used for driving, steering and adjusting the attitude of the vessel. According to a first example, the first section 107, 108 of each wing 103, 104 is mounted rotatable about the vertical axis $Y_1$ and $Y_2$, respectively, to facilitate turning of the vessel. According to a second example, the first section 107, 108 of each wing 103, 104 can also be mounted rotatable about a common transverse horizontal axis X axis at right angles to the central longitudinal axis of the vessel. The transverse horizontal axis X passes through the attachment points 105, 106 (one shown) of each upper end 107*a* (one shown) of the respective first section 107, 108. The rotation of the wings about the respective vertical axis $Y_1$ and $Y_2$ and/or the horizontal axis X is controllable by suitable electric or hydraulic actuators (not shown). The above-mentioned functions will be described in further detail below.

Figure 2:
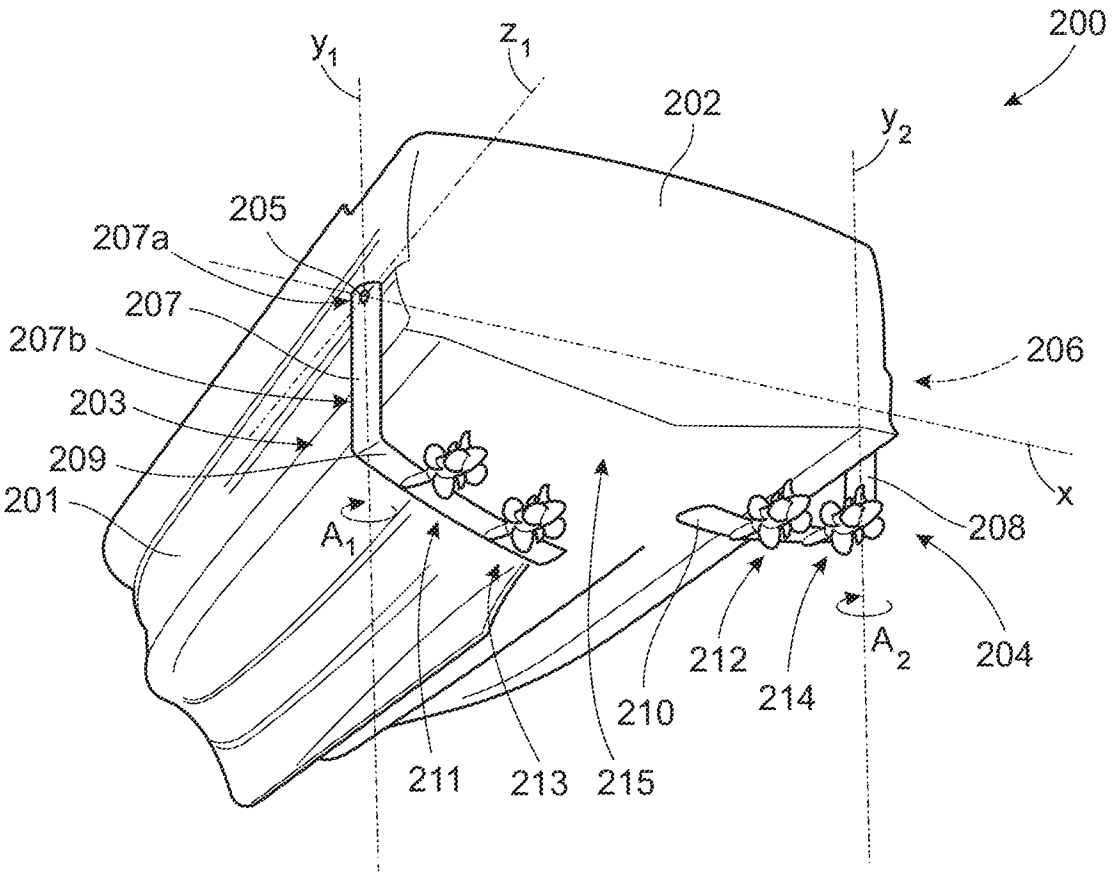
FIG. 2 shows a lower perspective rear view of the propulsion system in FIG. 1 with the wings rotated for turning.

FIG. 2 shows a lower perspective rear view of the propulsion system in FIG. 1 with the wings rotated for performing a turn. FIG. 2 shows a vessel 200 with a marine propulsion system comprising a set of wings 203, 204 with propulsors 211, 212, 213, 214. The wings 203, 204 are arranged for mounting at attachment points 205, 206 (one shown) on opposite longitudinal side sections 201 (one shown) above the waterline of a vessel comprising a single hull. The wings 203, 204 are located adjacent the transom 202 of the hull 215.

Each wing comprises a first section 207, 208 extending downwards along the side section 201 of the hull 215 and at least partially below the waterline when the wing is in its operative position. In this position, the first section 207, 208 is mounted to the side section 201 of the hull at or adjacent its upper end 207*a* (one shown). Each wing 203, 204 further comprises a second section 209, 210 joined to a lower end 207*b* (one shown) of the first section 207, 208. The second section 209, 210 extends at an obtuse angle away from the main extension of the first section 207, 208. The main extensions of the first sections 207,208 are indicated by the vertical axes $Y_1$ and $Y_2$, respectively, which axes pass through the respective attachment point 205, 206. The second section 209, 210 of each wing 203, 204 is arranged to support a pair of propulsors 211, 212, 213, 214.

In order to perform a turn, the first section 207, 208 of each wing 203, 204 is rotated in a desired direction about the vertical axes $Y_1$ and $Y_2$. FIG. 2 shows the wings 203, 204 rotated in a clockwise direction A1, A2 when viewed from below. This will cause the vessel to turn to starboard, as indicated in FIG. 3.

Figure 3:
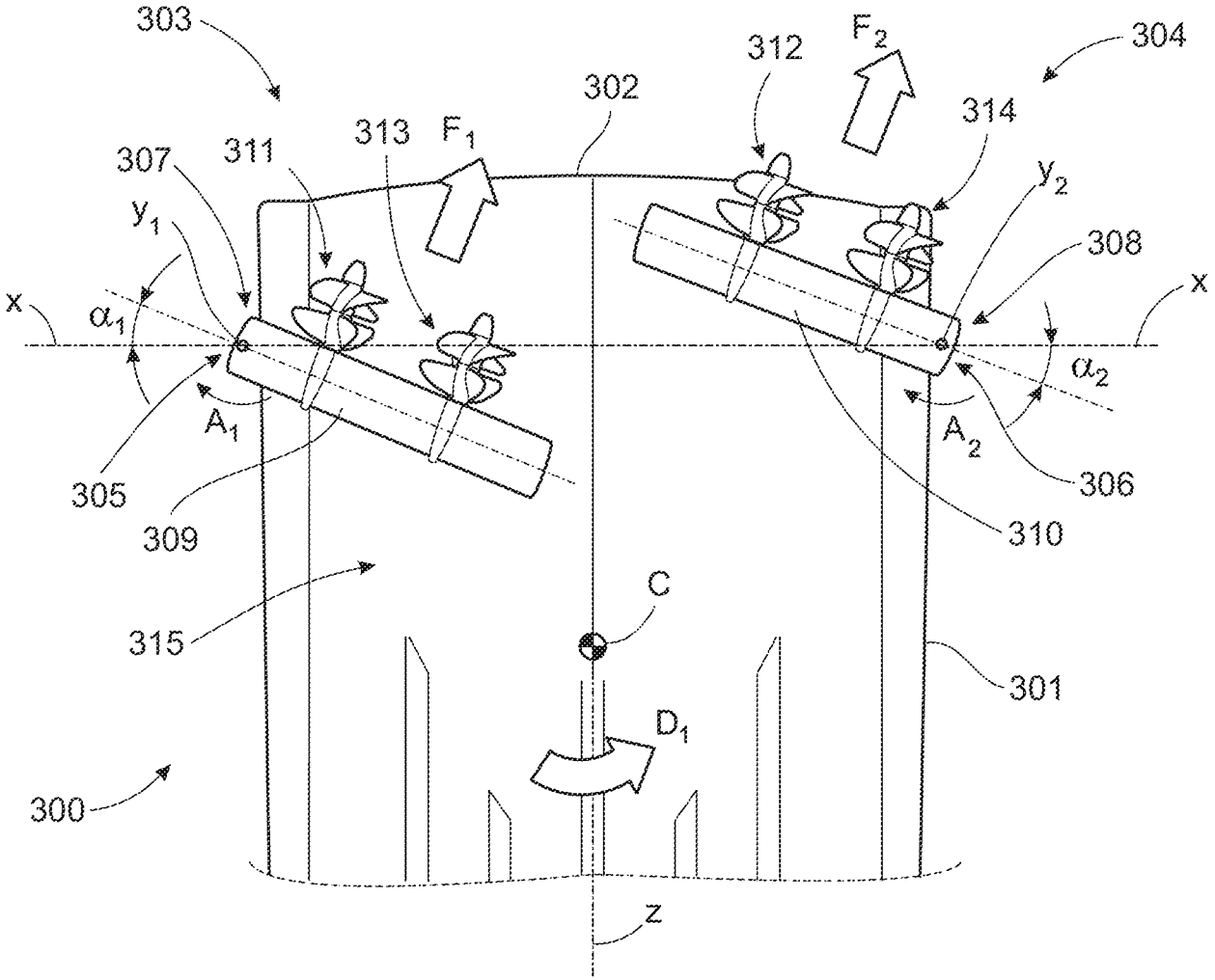
FIG. 3 shows a lower plan view of the propulsion system in in FIG. 2.

FIG. 3 shows a lower plan view of the propulsion system in FIG. 2 with the wings rotated for performing a turn. FIG. 3 shows a vessel 300 with a marine propulsion system comprising a set of wings 303, 304 with propulsors 311, 312, 313, 314. The wings 303, 304 are arranged for mounting at attachment points 305, 306 (one shown) on opposite longitudinal side sections 301 (one shown) above the waterline of a vessel comprising a single hull. The wings 303, 304 are located adjacent the transom 302 of the hull 315.

Each wing comprises a first section 307, 308 extending downwards along the side section 301 of the hull 315 and at least partially below the waterline when the wing is in its operative position. In this position, the first section 307, 308 is mounted to the side section 301 of the hull at or adjacent its upper end (not shown). Each wing 303, 304 further comprises a second section 309, 310 joined to a lower end (not shown) of the first section 307, 308. The second section 309, 310 extends at an obtuse angle away from the main extension of the first section 307, 308. The main extensions of the first sections 307, 308 are indicated by the vertical axes $Y_1$ and $Y_2$, respectively, which axes pass through the respective attachment point 305, 306. The second section 309, 310 of each wing 303, 304 is arranged to support a pair of propulsors 311, 312, 313, 314.

In order to perform a turn, the first section 307, 308 of each wing 303, 304 is rotated in a desired direction about the vertical axes $Y_1$ and $Y_2$. FIG. 3 shows the wings 303, 304 rotated over equal angles $\alpha_1$, $\alpha_2$ in a clockwise direction $A_1$, $A_2$ when viewed from below. When the propulsors 311, 312, 313, 314 are driven to propel the vessel forwards the resulting thrust forces $F_1$, $F_2$ will cause a turning moment about the center of gravity C of the vessel. In this example the center of gravity C is assumed to coincide with the central longitudinal axis Z of the vessel. The turning moment about the center of gravity C will cause the vessel to turn to starboard, as indicated by the arrow $D_1$ in FIG. 3.

Figure 4:
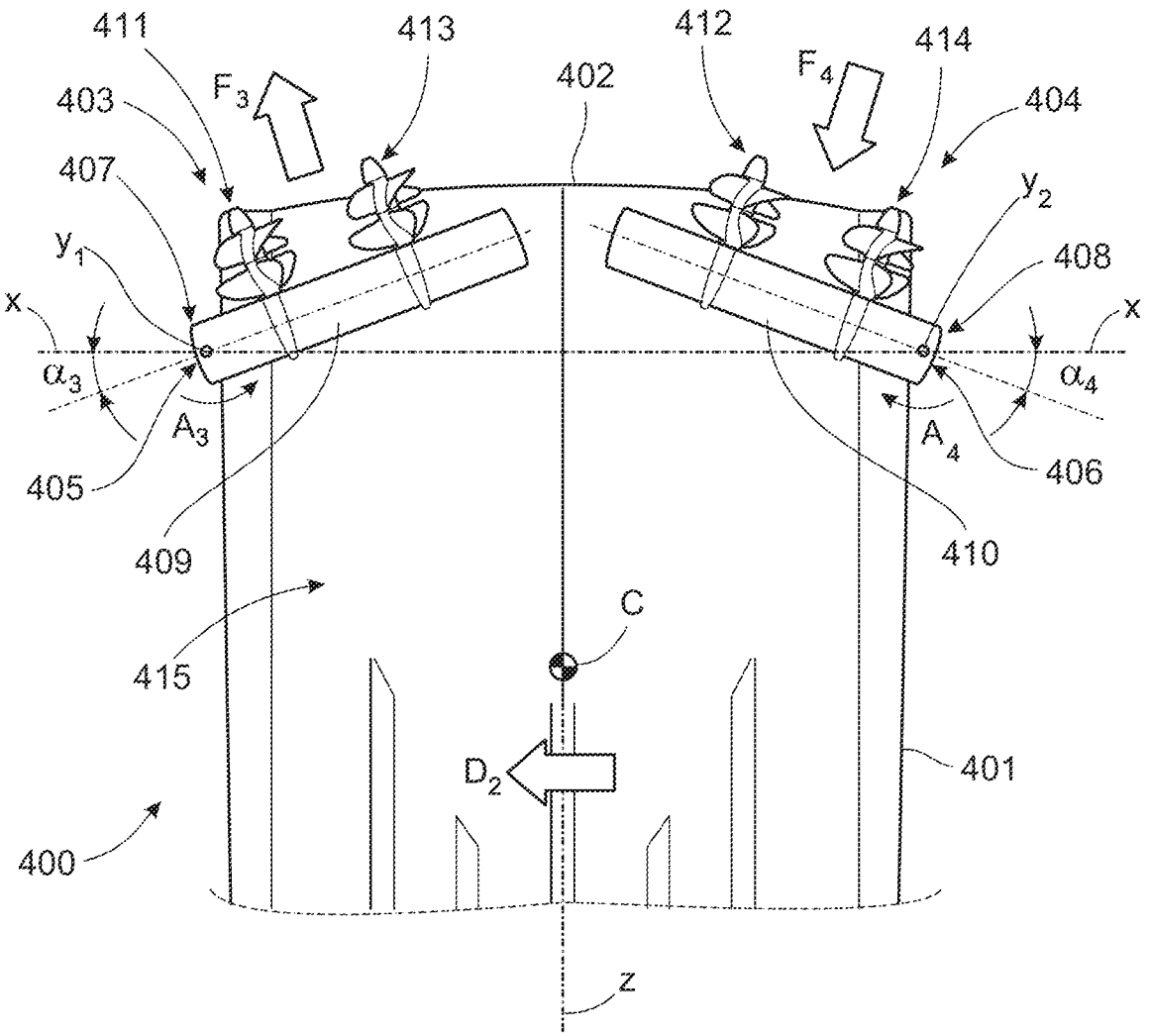
FIG. 4 shows a lower plan view of the propulsion system in FIG. 2 with the wings rotated for a docking manoeuvre.

FIG. 4 shows a lower plan view of the propulsion system in FIG. 2 with the wings rotated for a docking manoeuvre. FIG. 4 shows a vessel 400 with a marine propulsion system comprising a set of wings 403, 404 with propulsors 411, 412, 413, 414. The wings 403, 404 are arranged for mounting at attachment points 405, 406 (one shown) on opposite longitudinal side sections 401 (one shown) above the waterline of a vessel comprising a single hull. The wings 403, 404 are located adjacent the transom 402 of the hull 415.

Each wing comprises a first section 407, 408 extending downwards along the side section 401 of the hull 415 and at least partially below the waterline when the wing is in its operative position. In this position, the first section 407, 408 is mounted to the side section 401 of the hull at or adjacent its upper end 407*a* (one shown). Each wing 403, 404 further comprises a second section 409, 410 joined to a lower end 407*b* (one shown) of the first section 407, 408. The second section 409, 410 extends at an obtuse angle away from the main extension of the first section 407, 408. The main extensions of the first sections 407, 408 are indicated by the vertical axes $Y_1$ and $Y_2$, respectively, which axes pass through the respective attachment point 405, 406. The second section 409, 410 of each wing 403, 404 is arranged to support a pair of propulsors 411, 412, 413, 414.

In order to perform a docking maneuver, the first section 407, 408 of each wing 403, 404 is rotated in desired individual directions about the vertical axes $Y_1$ and $Y_2$. FIG. 4 shows an example where the first wing 403 is rotated over an angle $\alpha_3$ in an anti-clockwise direction $A_3$ and the second wing 404 is rotated over an equal and opposite angle $\alpha_4$ in a clockwise direction $A_4$ when viewed from below. When the propulsors 411, 413 on the first wing 403 are driven to propel the vessel forwards and the propulsors 412, 414 on the second wing 404 are driven to propel the vessel rearwards the resulting thrust forces $F_3$ and $F_4$ will cause a lateral force on the center of gravity C of the vessel. In this example the center of gravity C is assumed to coincide with the central longitudinal axis Z of the vessel. The lateral force on the center of gravity C will cause the vessel to be displaced sideways to port, as indicated by the arrow $D_2$ in FIG. 4. Such a maneuver is used for e.g. docking the vessel in a marina.

Figure 5:
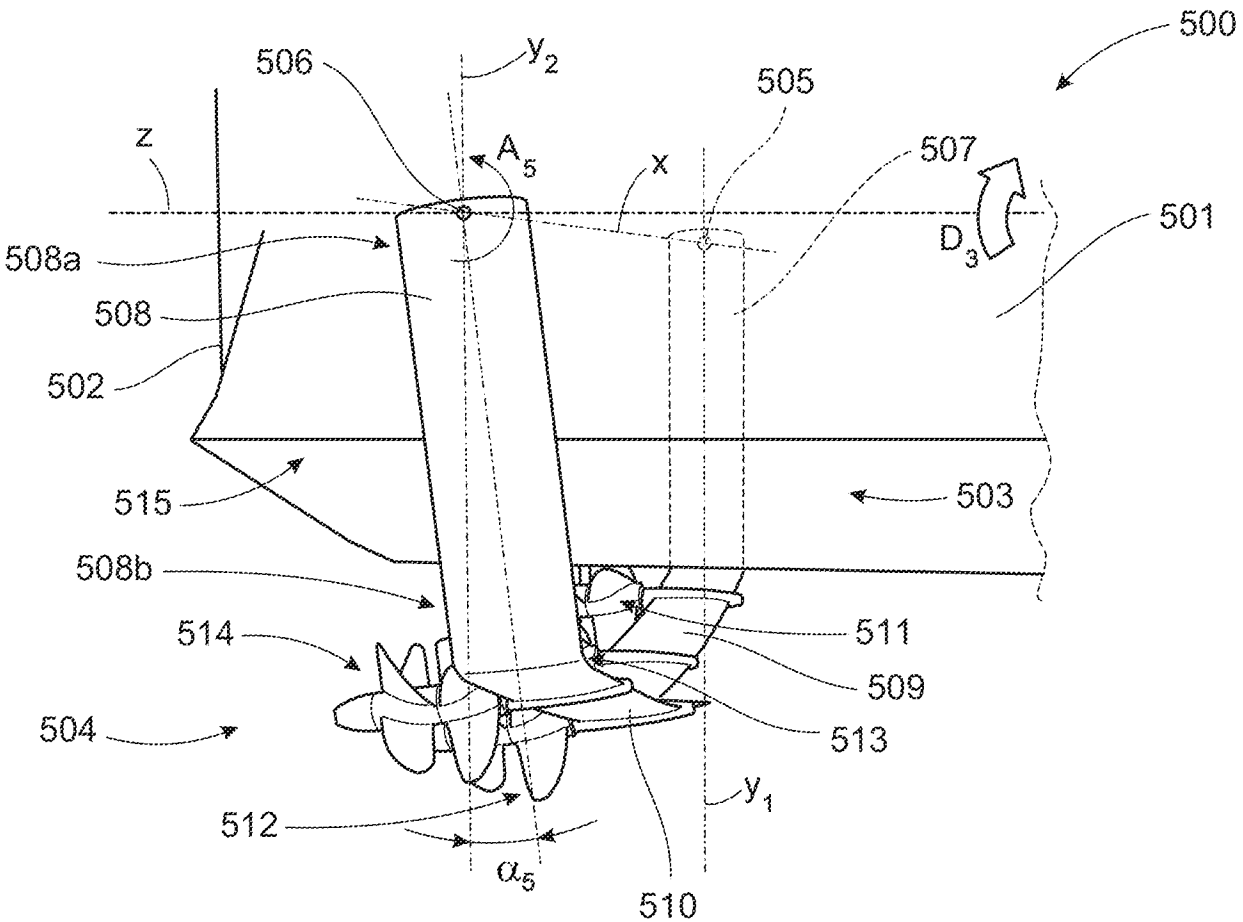
FIG. 5 shows a perspective side view of the propulsion system in FIG. 1 with one wing pivoted for counteracting list.

FIG. 5 shows a perspective side view of the propulsion system in FIG. 1 with one wing pivoted for counteracting list when the marine vessel moves forward. FIG. 5 shows a vessel 500 with a marine propulsion system comprising a set of wings 503, 504 with propulsors 511, 512, 513, 514. The wings 503, 504 are arranged for mounting at attachment points 505, 506 on opposite longitudinal side sections 501 (one shown) above the waterline of a vessel comprising a single hull. The wings 503, 504 are located adjacent the transom 502 of the hull 515.

Each wing comprises a first section 507, 508 extending downwards along the side section 501 of the hull 515 and at least partially below the waterline when the wing is in its operative position. In this position, the first section 507, 508 is mounted to the side section 501 of the hull at or adjacent its upper end 508*a* (one shown). Each wing 503, 504 further comprises a second section 509, 510 joined to a lower end 508*b* (one shown) of the first section 507, 508. The second section 509, 510 extends at an obtuse angle away from the main extension of the first section 507, 508. The main extensions of the first sections 507, 508 are indicated by the vertical axes $Y_1$ and $Y_2$, respectively, which axes pass through the respective attachment point 505, 506. The second section 509, 510 of each wing 503, 504 is arranged to support a pair of propulsors 511, 512, 513, 514.

When the wings 503, 504 are located in their operative positions, the wings 503, 504 and their propulsors 511, 512, 513, 514 can be used for adjusting undesired list of the vessel. As indicated above, the first section 507, 508 of each wing 503, 504 is mounted rotatable about the vertical axis $Y_1$ and $Y_2$, respectively, to facilitate turning of the vessel. In addition, the first section 507, 508 of each wing 503, 504 can also be mounted rotatable about a common transverse horizontal axis X axis at right angles to the central longitudinal axis Z of the vessel. The transverse horizontal axis X passes through the attachment points 505, 506 of each upper end 508*a* (one shown) of the respective first section 507, 508. In the example in FIG. 5, the starboard wing 504 has been rotated counterclockwise over an angle $\alpha_5$ in the direction of the arrow $A_5$ about the transverse axis X. The port wing 503 is maintained in its vertical datum position. This will cause the second section 510 of the starboard wing 504 to be moved forward relative to the vertical axis $Y_2$. In this position, the foil-shaped second section 510 will impart a lifting force on the starboard wing 504, causing a turning moment in the counterclockwise direction $D_5$ about the central longitudinal axis Z of the vessel when the marine vessel moves forward. By adjusting the angle $\alpha_5$ it is possible to correct the attitude of a hull that is listing to starboard.

Figure 6:
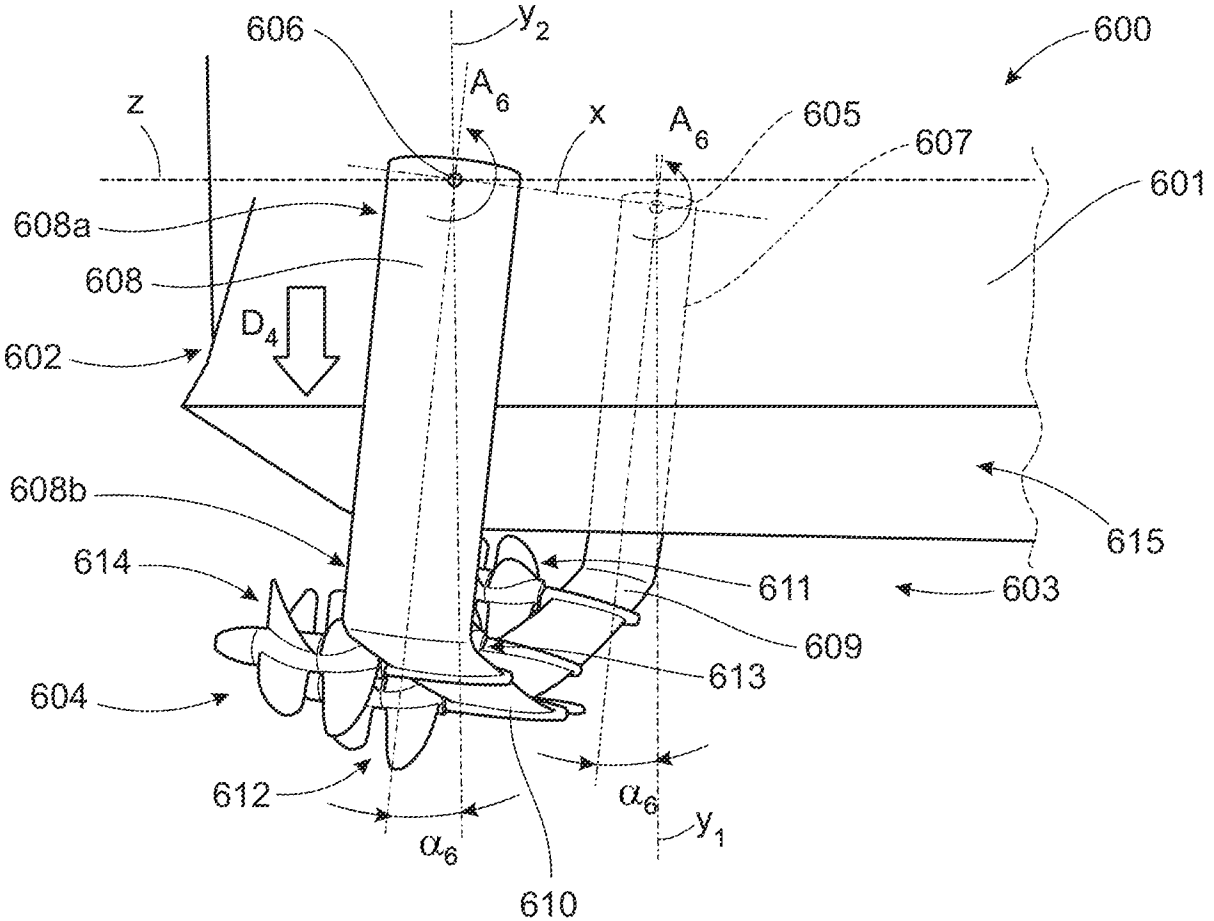
FIG. 6 shows a perspective side view of the propulsion system in FIG. 1 with the wings pivoted for trim.

FIG. 6 shows a perspective side view of the propulsion system in FIG. 1 with the wings pivoted for trim. FIG. 6 shows a vessel 600 with a marine propulsion system comprising a set of wings 603, 604 with propulsors 611, 612, 613, 614. The wings 603, 604 are arranged for mounting at attachment points 605, 606 on opposite longitudinal side sections 601 (one shown) above the waterline of a vessel comprising a single hull. The wings 603, 604 are located adjacent the transom 602 of the hull 615.

Each wing comprises a first section 607, 608 extending downwards along the side section 601 of the hull 615 and at least partially below the waterline when the wing is in its operative position. In this position, the first section 607, 608 is mounted to the side section 601 of the hull at or adjacent its upper end 608*a* (one shown). Each wing 603, 604 further comprises a second section 609, 610 joined to a lower end 608*b* (one shown) of the first section 607, 608. The second section 609, 610 extends at an obtuse angle away from the main extension of the first section 607, 608. The main extensions of the first sections 607, 608 are indicated by the vertical axes $Y_1$ and $Y_2$, respectively, which axes pass through the respective attachment point 605, 606. The second section 609, 610 of each wing 603, 604 is arranged to support a pair of propulsors 611, 612, 613, 614.

When the wings 603, 604 are located in their operative positions, the wings 603, 604 and their propulsors 611, 612, 613, 614 can be used for adjusting undesired list of the vessel. As indicated above, the first section 607, 608 of each wing 603, 604 is mounted rotatable about the vertical axis $Y_1$ and $Y_2$, respectively, to facilitate turning of the vessel. In addition, the first section 607, 608 of each wing 603, 604 can also be mounted rotatable about a common transverse horizontal axis X axis at right angles to the central longitudinal axis Z of the vessel. The transverse horizontal axis X passes through the attachment points 605, 606 of each upper end 608*a* (one shown) of the respective first section 607, 608. In the example in FIG. 6, the both wings 603, 604 have been rotated clockwise over an angle $\alpha_6$ in the direction of the arrow $A_6$ about the transverse axis X. This will cause the second section 609, 610 of each wing 603, 604 to be moved rearward relative to the vertical axes $Y_1$, $Y_2$. In this position, the foil-shaped second sections 609, 610 will impart a downward force on their respective wing 603, 604, causing a turning moment in the counterclockwise direction $D_4$ about the center of gravity (not shown) of the vessel when the marine vessel moves forward. By adjusting the angle $\alpha_6$ relative to the vertical axes $Y_1$, $Y_2$ it is possible to adjust the trim of the vessel in different directions. The example in FIG. 6 can be used to trim the stern of the vessel downwards, e.g. for wakeboarding.

Figure 7:
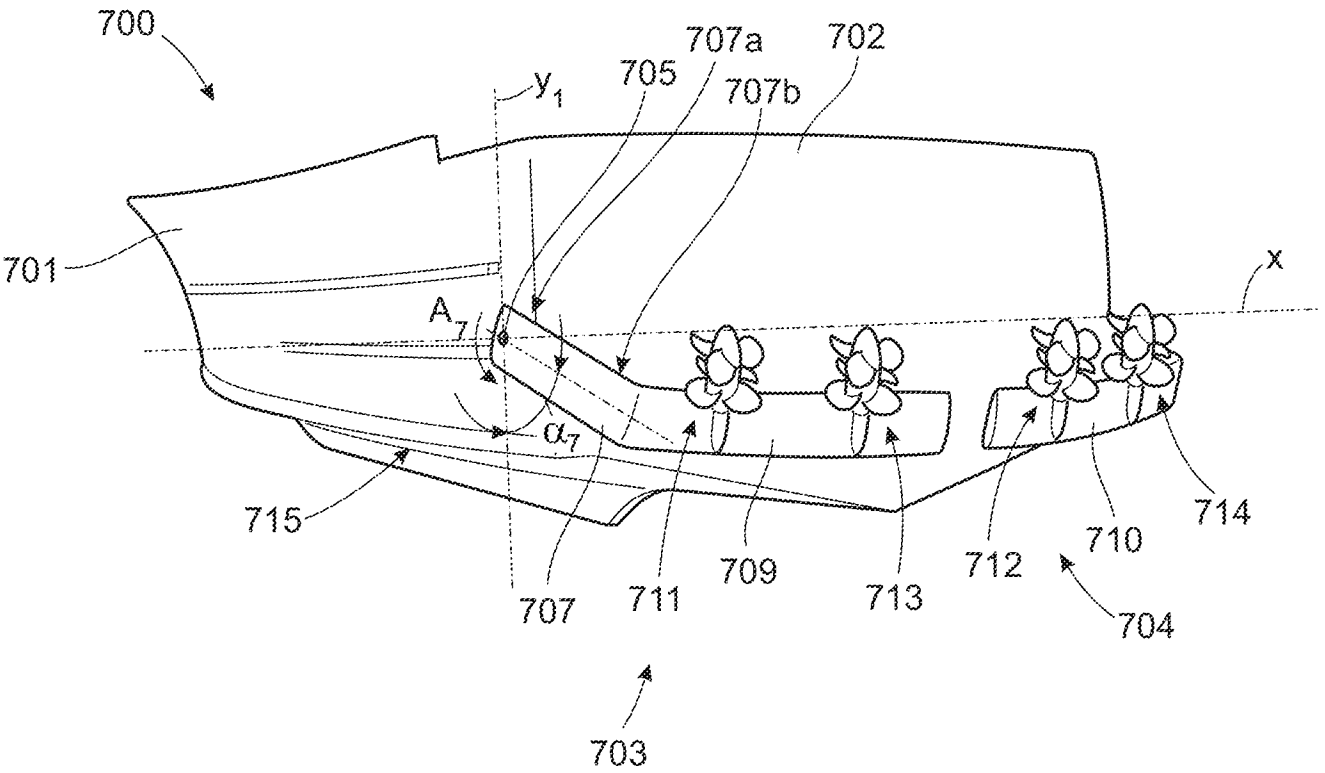
FIG. 7 shows a perspective rear view of a vessel with a marine propulsion system comprising a set of wings in a first inoperative position.

FIG. 7 shows a perspective rear view of a vessel with a marine propulsion system comprising a set of wings 703, 704 with propulsors 711, 712, 713, 714 a first inoperative position. The wings 703, 704 have a hydrofoil shaped geometry and are arranged for mounting at attachment points 705 (one shown) on opposite longitudinal side sections 701 (one shown) above the waterline of a vessel comprising a single hull. The wings 703, 704 are located adjacent the transom 702 of the hull onto which they are mounted. Each wing comprises a first section 707, 708 extending downwards along the side section 701 of the hull 715 and at least partially below the waterline when the wing is in its operative position. In this position, the first section 707, 708 is mounted to the side section 701 of the hull at or adjacent its upper end 707*a* (one shown). Each wing 703, 704 further comprises a second section 709, 710 joined to a lower end 707*b* (one shown) of the first section 707, 708.

In addition to the operative position described in FIGS. 1-6 above, the wings 703, 704 can be displaced into at least one inoperative position. FIG. 7 shows a first inoperative position, wherein each wing 703, 704 has been rotated in the direction of the arrow $A_7$ over an angle $\alpha_7$, rearwards and upwards from an operative position (see FIG. 1) into a first inoperative position. In the first inoperative position each first section 707, 708 extends rearwards relative to the operative position and each second section 709, 710 and the propulsors 711, 712, 713, 714 are arranged rearwards of the transom and above the waterline. The pivoted angle $\alpha_7$ is preferably selected so that the propulsion system is clear of the water. This position is suitable for lifting the propulsors out of the water during mooring, in order to reduce the effects of marine growth and corrosion during periods of inactivity. In this example, the location of the attachment points 705 on the side sections 701 of the hull, the length of the first section 707, 708 and the angle between the first sections 707, 708 and the second sections 709, 710 are selected to allow the second sections 709, 710 and the propulsors 711, 712, 713, 714 to pass below and upwards behind the transom 702 during a displacement of the wings from the operative position to the first inoperative position.

Figure 8:
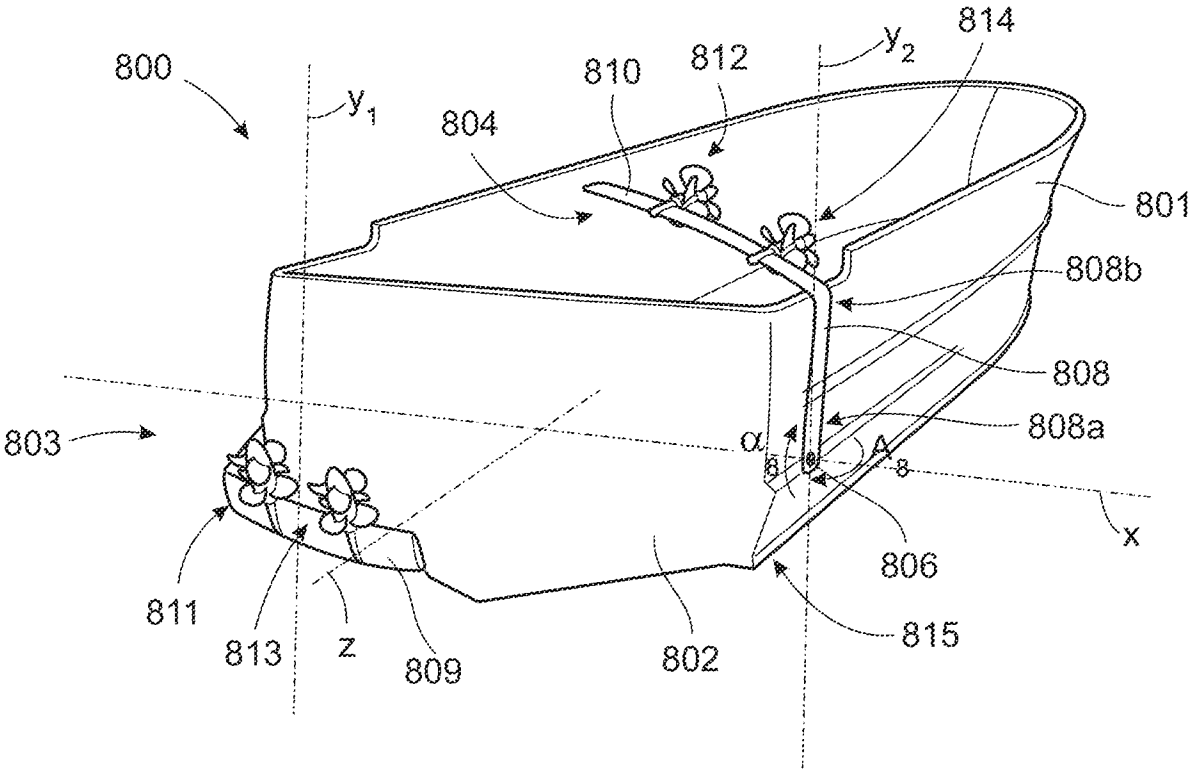
FIG. 8 shows a perspective rear view of the propulsion system in FIG. 1 with one wing in a second inoperative position.

FIG. 8 shows a perspective rear view of a vessel with a marine propulsion system comprising a set of wings 803, 804 with propulsors 811, 812, 813, 814 with one wing 804 in a second inoperative position. The wings 803, 804 have a hydrofoil shaped geometry and are arranged for mounting at attachment points 805 (one shown) on opposite longitudinal side sections 801 (one shown) above the waterline of a vessel comprising a single hull. The wings 803, 804 are located adjacent the transom 802 of the hull onto which they are mounted. Each wing comprises a first section 807, 808 extending downwards along the side section 801 of the hull 815 and at least partially below the waterline when the wing is in its operative position. In this position, the first section 807, 808 is mounted to the side section 801 of the hull at or adjacent its upper end 807*a* (one shown). Each wing 803, 804 further comprises a second section 809, 810 joined to a lower end 807*b* (one shown) of the first section 807, 808.

In addition to the operative position described in FIGS. 1-6 and the first inoperative position described in FIG. 7 above, the wings 803, 804 can be displaced into a second inoperative position. FIG. 8 shows an example of a second inoperative position, wherein a first wing 803 has been rotated into a first inoperative position, as shown in FIG. 7, and a second wing 804 has been rotated in the direction of the arrow $A_8$ over an angle $\alpha_8$, rearwards and upwards from an operative position (see FIG. 1) into a second inoperative position. In the second inoperative position the first section 808 of the second wing 804 extends upwards relative to the operative position and the second section 810 and the propulsors 812, 814 are arranged above the transom and the hull. The pivoted angle $\alpha_8$ can be at least 180° so that the propulsion system is accessible from the deck of the vessel. This position is suitable for lifting the propulsors clear of the hull to a height and position wherein the propulsors and the wings are accessible for service. In this way, service and maintenance can be performed without having to remove any parts or the propulsion system from the vessel. In this example, the location of the attachment points 805 on the side sections 801 of the hull, the length of the first section 807, 808 and the angle between the first sections 807, 808 and the second sections 809, 810 are selected to allow the second sections 809, 810 and the propulsors 811, 812, 813, 814 to pass upwards behind the transom 802 and above the hull during a displacement of the wings from the operative position to the second inoperative position.

Figure 9:
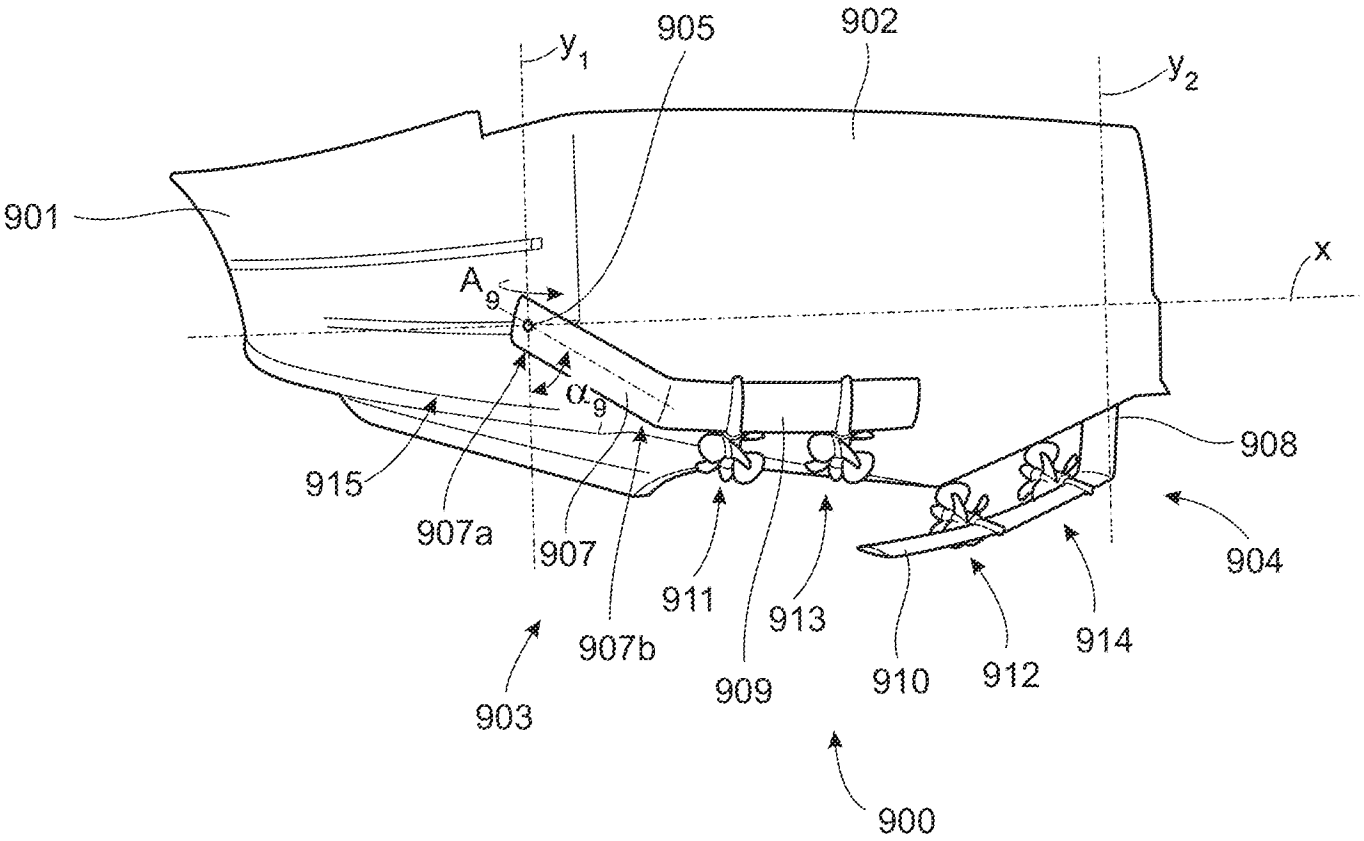
FIG. 9 shows a perspective rear view of a schematically illustrated vessel with a marine propulsion system comprising a set of wings with pulling propellers.

FIG. 9 shows a perspective rear view of a schematically illustrated vessel with a marine propulsion system comprising a set of wings with pulling propellers. FIG. 9 shows a set of wings 903, 904 with propulsors 911, 912, 913, 914 with one wing a first wing 903 in a first inoperative position (see FIG. 7) and a second wing 904 in an operative position (see FIG. 1). The first wing 903 has been rotated in the direction of the arrow $A_9$ over an angle $\alpha_9$, rearwards and upwards from an operative position into the first inoperative position. The wings 903, 904 have a hydrofoil shaped geometry and are arranged for mounting at attachment points 905 (one shown) on opposite longitudinal side sections 901 (one shown) above the waterline of a vessel comprising a single hull. The wings 903, 904 are located adjacent the transom 902 of the hull onto which they are mounted. Each wing comprises a first section 907, 908 extending downwards along the side section 901 of the hull 915 and at least partially below the waterline when the wing is in its operative position. In this position, the first section 907, 908 is mounted to the side section 901 of the hull at or adjacent its upper end 907*a* (one shown). Each wing 903, 904 further comprises a second section 909, 910 joined to a lower end 907*b* (one shown) of the first section 907, 908. The embodiment in FIG. 9 illustrates the use of propulsors 911, 912, 913, 914 with forward facing, pulling propellers.

Figure 10:
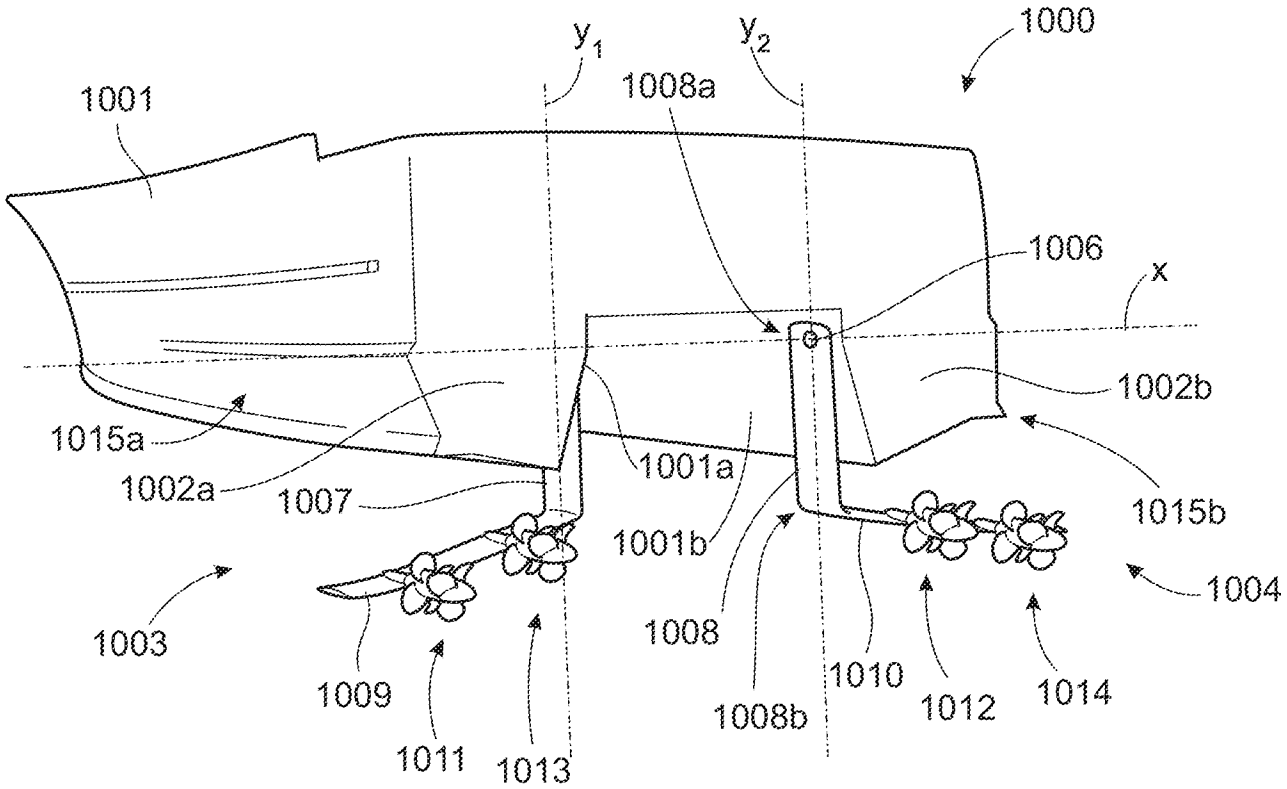
FIG. 10 shows a perspective rear view of a schematically illustrated catamaran with a marine propulsion system comprising a set of wings in an operative position.

FIG. 10 shows a perspective rear view of a schematically illustrated catamaran 1000 with a marine propulsion system comprising a set of wings 1003, 1004 with propulsors 1011, 1012, 1013, 1014 in an operative position. The wings 1003, 1004 have a hydrofoil shaped geometry and are arranged for mounting at attachment points 1006 (one shown) on opposite longitudinal side sections 1001*a*, 1001*b* which are arranged facing each other above the waterline between parallel twin hulls 1015*a*, 1015*b*. The wings 1003, 1004 are located adjacent the transom 1002*a*, 1002*b* of the hull onto which they are mounted. Each wing comprises a first section 1007, 1008 extending downwards along the side section 1001*a*, 1001*b* of the respective hull 1015*a*, 1015*b* and at least partially below the waterline when the wing is in its operative position. In this position, the first section 1007, 1008 is mounted to the side section 1001*a*, 1001*b* of the respective hull at or adjacent its upper end 1008*a* (one shown). Each wing 1003, 1004 further comprises a second section 1009, 1010 joined to a lower end 1008*b* (one shown) of the first section 1007, 1008. Each second section 1009, 1010 extends from the lower end of its corresponding first section 1007, 1008 of a respective wing 1003, 1004 and towards the central longitudinal axis of the hull 1015*a*, 1015*b* on which the wing is mounted (see FIG. 11; axes $Z_1$ and $Z_2$). In the above example, the second sections 1009, 1010 of each pair of wings 1003, 1004 will extend away from each other.

Figure 11:
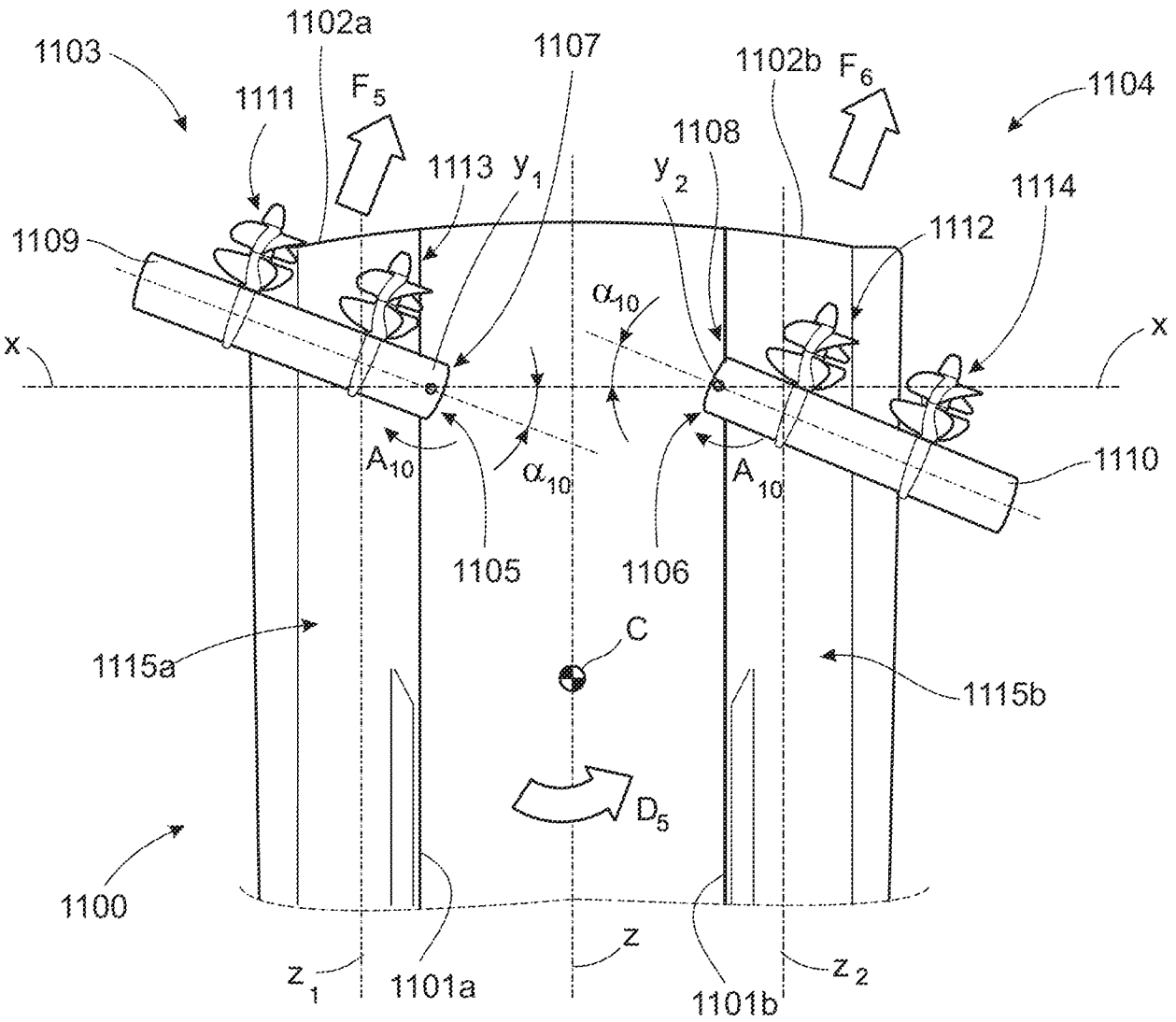
FIG. 11 shows a lower plan view of the propulsion system in in FIG. 10 with the wings rotated for turning.

FIG. 11 shows a lower plan view of the marine propulsion system for the catamaran in FIG. 10 with the wings rotated for performing a turn. FIG. 11 shows a vessel 1100 with a marine propulsion system comprising a set of wings 1103, 1104 with propulsors 1111, 1112, 1113, 1114. The wings 1103, 1104 are arranged for mounting at attachment points 1105, 1106 on opposite longitudinal side sections 1101*a*, 1101*b* which are arranged facing each other above the waterline between parallel twin hulls 1115*a*, 1115*b*. The wings 1103, 1104 are located adjacent the transoms 1102*a*, 1102*b* of the respective hull 1115*a*, 1115*b*.

Each wing comprises a first section 1107, 1108 extending downwards along each of the facing the side sections 1101*a*, 1101*b* of the respective hull 1115*a*, 1115*b* and at least partially below the waterline when the wing is in its operative position. In this position, the first sections 1107, 1108 are mounted to a respective side section 1101*a*, 1101*b* of each hull at or adjacent its upper end (see FIG. 10). Each wing 1103, 1104 further comprises a second section 1109, 1110 joined to a lower end (see FIG. 10) of the first section 1107, 1108. The second section 1109, 1110 extends at an obtuse angle away from the main extension of the first section 1107, 1108. The main extensions of the first sections 1107, 1108 are indicated by the vertical axes $Y_1$ and $Y_2$, respectively, which axes pass through the respective attachment point 1105, 1106 (see FIG. 10; "1006"). The second section 1109, 1110 of each wing 1103, 1104 is arranged to support a pair of propulsors 1111, 1112, 1113, 1114. Each second section 1109, 1110 extends from the lower end of its corresponding first section 1107, 1108 of the respective wing 1103, 1104 and towards the central longitudinal axis $Z_1$, $Z_2$ of the hull 1115*a*, 1115*b* on which the wing is mounted. In this example, the second section 1109, 1110 extend away from each other.

In order to perform a turn, the first section 1107, 1108 of each wing 1103, 1104 is rotated in a desired direction about the vertical axes $Y_1$ and $Y_2$. FIG. 11 shows the wings 1103, 1104 rotated over equal angles $\alpha_{10}$ in a clockwise direction when viewed from below, as indicated by the arrows $A_{10}$. When the propulsors 1111, 1112, 1113, 1114 are driven to propel the vessel forwards the resulting thrust forces $F_5$, $F_6$ will cause a turning moment about the center of gravity C of the vessel when the marine vessel moves forward. In this example the center of gravity C is assumed to coincide with the central longitudinal axis Z of the vessel. The turning moment about the center of gravity C will cause the vessel to turn to starboard, as indicated by the arrow $D_5$ in FIG. 11.

Figure 12:
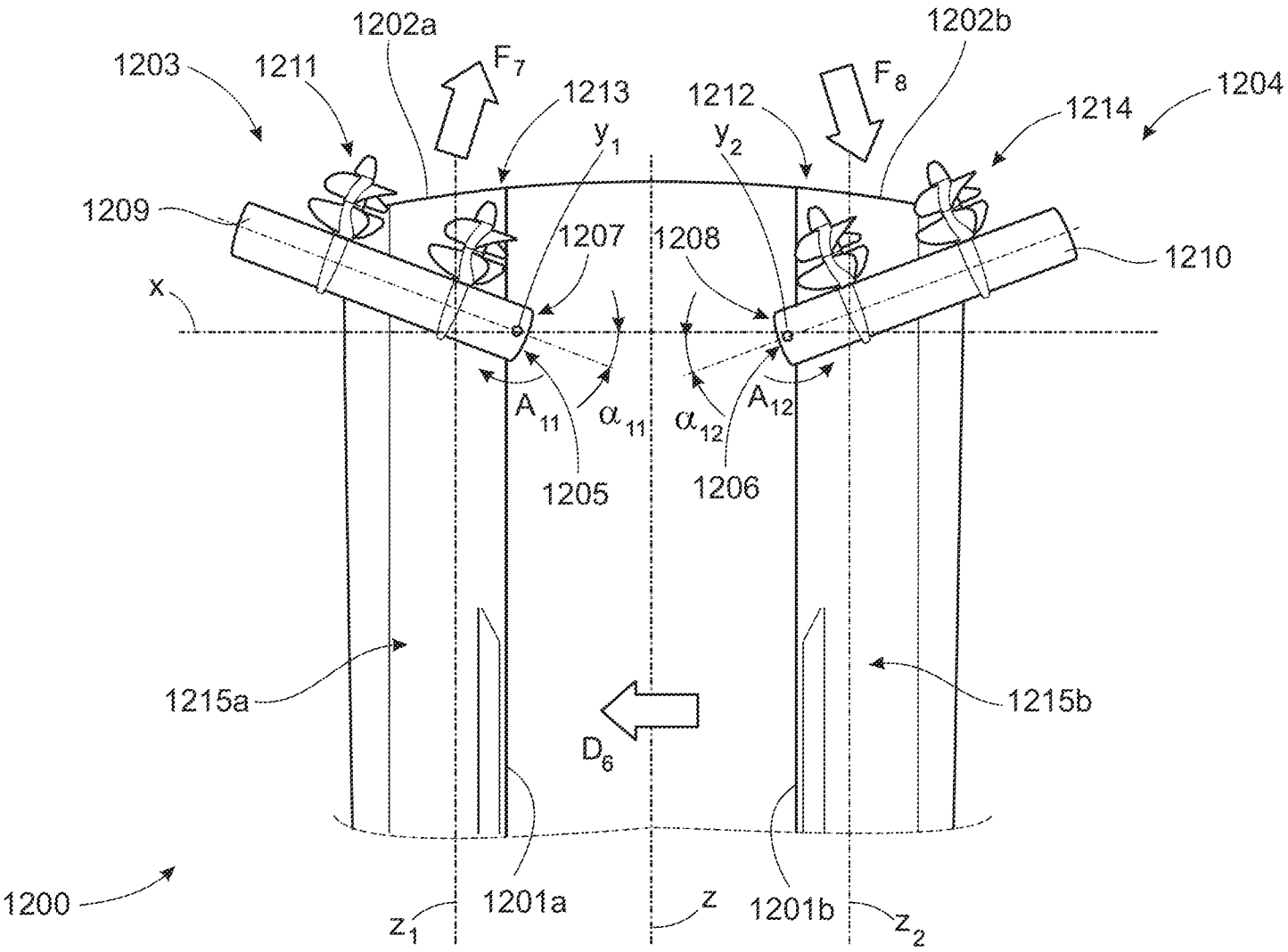
FIG. 12 shows a lower plan view of the propulsion system in FIG. 10 with the wings rotated for a docking manoeuvre.

FIG. 12 shows a lower plan view of the marine propulsion system for the catamaran in FIG. 10 with the wings rotated for a docking manoeuvre. FIG. 12 shows a vessel 1200 with a marine propulsion system comprising a set of wings 1203, 1204 with propulsors 1211, 1212, 1213, 1214. The wings 1203, 1204 are arranged for mounting at attachment points 1205, 1206 on opposite longitudinal side sections 1201*a*, 1201*b* which are arranged facing each other above the waterline between parallel twin hulls 1115*a*, 1115*b*. The wings 1203, 1204 are located adjacent the transoms 1202*a*, 1202*b* of the respective hull 1215*a*, 1215*b*.

Each wing comprises a first section 1207, 1208 extending downwards along each of the facing the side sections 1201*a*, 1201*b* of the respective hull 1215*a*, 1215*b* and at least partially below the waterline when the wing is in its operative position. In this position, the first sections 1207, 1208 are mounted to a respective side section 1101*a*, 1101*b* of each hull at or adjacent its upper end (see FIG. 10). Each wing 1203, 1204 further comprises a second section 1209, 1210 joined to a lower end (see FIG. 10) of the first section 1207, 1208. The second section 1209, 1210 extends at an obtuse angle away from the main extension of the first section 1207, 1208. The main extensions of the first sections 1207, 1208 are indicated by the vertical axes $Y_1$ and $Y_2$, respectively, which axes pass through the respective attachment point 1205, 1206 (see FIG. 10; "1006"). The second section 1209, 1210 of each wing 1203, 1204 is arranged to support a pair of propulsors 1211, 1212, 1213, 1214. Each second section 1109, 1110 extends from the lower end of its corresponding first section 1107, 1108 of the respective wing 1103, 1104 and towards the central longitudinal axis $Z_1$, $Z_2$ of the hull 1115*a*, 1115*b* on which the wing is mounted. In this example, the second section 1109, 1110 extend away from each other.

In order to perform a docking maneuver, the first section 1207, 1208 of each wing 1203, 1204 is rotated in desired individual directions about the vertical axes $Y_1$ and $Y_2$. FIG. 12 shows an example where the first wing 1203 is rotated over an angle $\alpha_{11}$ in an anti-clockwise direction, as indicated by the arrow $A_{11}$, and the second wing 1204 is rotated over an equal and opposite angle $\alpha_{12}$ in a clockwise direction, as indicated by the arrow $A_{12}$ when viewed from below. When the propulsors 1211, 1213 on the first wing 1203 are driven to propel the vessel forwards and the propulsors 1212, 1214 on the second wing 1204 are driven to propel the vessel rearwards the resulting thrust forces $F_7$ and $F_8$ will cause a lateral force on the center of gravity C of the vessel. In this example the center of gravity C is assumed to coincide with the central longitudinal axis Z of the vessel. The lateral force on the center of gravity C will cause the vessel to be displaced sideways to port, as indicated by the arrow $D_6$ in FIG. 12. Such a maneuver is used for e.g. docking the vessel in a marina.

It is to be understood that the present disclosure is not limited to the embodiments described above and illustrated in the drawings; rather, the skilled person will recognize that many changes and modifications may be made within the scope of the appended claims.

The invention claimed is:

1. A marine propulsion system comprising wings with a hydrofoil shaped geometry arranged for mounting on opposite side sections of a vessel comprising at least one hull adjacent the transom, wherein:

each wing comprises a first section extending downwards along the side of the hull and at least partially below the waterline in its operative position;

each wing comprises a second section extending towards the central longitudinal axis of the hull in its operative position, the second section of each wing is arranged to support at least one propulsor, and the first section of each wing is mounted rotatable about a vertical axis, wherein both wings are rotatable simultaneously in the same direction about their vertical axes to facilitate turning of the vessel.

2. The marine propulsion system according to claim 1, wherein each wing is individually rotatable about its vertical axis to facilitate low speed manoeuvring of the vessel.

3. The marine propulsion system according to claim 1, wherein the first section of each wing is rotatable about a common horizontal axis at right angles to the central longitudinal axis of the vessel.

4. A marine propulsion system comprising wings with a hydrofoil shaped geometry arranged for mounting on opposite side sections of a vessel comprising at least one hull adjacent the transom, wherein:

each wing comprises a first section extending downwards along the side of the hull and at least partially below the waterline in its operative position;

each wing comprises a second section extending towards the central longitudinal axis of the hull in its operative position, the second section of each wing is arranged to support at least one propulsor, and the first section of each wing is mounted rotatable about a vertical axis, wherein the first section of each wing is rotatable about a common horizontal axis at right angles to the central longitudinal axis of the vessel, wherein the first sections are rotatable an equal angle about the horizontal axis to facilitate trim of the at least one hull.

5. The marine propulsion system according to claim 3, wherein each first section is rotatable to unequal angles about the horizontal axis to facilitate counteraction of list of the at least one hull.

6. A marine propulsion system comprising wings with a hydrofoil shaped geometry arranged for mounting on opposite side sections of a vessel comprising at least one hull adjacent the transom, wherein:

each wing comprises a first section extending downwards along the side of the hull and at least partially below the waterline in its operative position;

each wing comprises a second section extending towards the central longitudinal axis of the hull in its operative position, the second section of each wing is arranged to support at least one propulsor, and the first section of each wing is mounted rotatable about a vertical axis, wherein each wing is rotatable from its operative position into a first inoperative position, where the first section extends rearwards relative to its operative position and where the second section and the at least one propulsor are arranged rearwards of the transom.

7. The marine propulsion system according to claim 1, wherein each wing is rotatable from its operative position into a second inoperative position, where the first section extends upwards relative to its operative position and where the second section and the at least one propulsor are arranged above the transom.

8. The marine propulsion system according to claim 1, wherein the at least one propulsor comprises an electric motor.

9. The marine propulsion system according to claim 1, wherein the at least one propulsor comprises a pushing thruster.

10. The marine propulsion system according to claim 1, wherein the at least one propulsor comprises a pulling thruster.

11. A marine vessel wherein the vessel comprises the marine propulsion system according to claim 1.

* * * * *